US006200044B1

(12) United States Patent
Berger

(10) Patent No.: US 6,200,044 B1
(45) Date of Patent: Mar. 13, 2001

(54) DEVICE WITH A MARK-HOLDER HOPPER AND A REVOLVER HOPPER FOR STAMPING DISTINGUISHING MARKS ON MOVING PARTS

(76) Inventor: Bruno Berger, Josef Reiter-Strasse 35, A-5280, Braunau (AU)

( * ) Notice: Subject to any disclaimer, the term of this patent is extended or adjusted under 35 U.S.C. 154(b) by 0 days.

(21) Appl. No.: 09/555,703

(22) PCT Filed: Dec. 4, 1998

(86) PCT No.: PCT/AT98/00296

§ 371 Date: Jun. 5, 2000

§ 102(e) Date: Jun. 5, 2000

(87) PCT Pub. No.: WO99/29518

PCT Pub. Date: Jun. 17, 1999

(30) Foreign Application Priority Data

Dec. 5, 1997 (HU) ..... 40918/97
Dec. 5, 1997 (HU) ..... 40920/97
Mar. 16, 1998 (HU) ..... 9268/98

(51) Int. Cl.[7] ..... B41J 1/00

(52) U.S. Cl. ..... 400/139; 101/18; 101/29; 101/477; 29/568

(58) Field of Search ..... 400/139; 101/477, 101/3.1, 4, 13, 17, 18, 19, 21, 22, 23, 29, 32, 36, 91; 29/568

(56) References Cited

U.S. PATENT DOCUMENTS 4,044,665 * 8/1977 Kuhne et al. ..... 101/21
4,218,816 8/1980 Dormehl .
4,327,635 5/1982 Kelly et al. .
4,414,724 * 11/1983 Garnett ..... 29/568
4,414,733 * 11/1983 Janotick ..... 29/568
4,542,998 * 9/1985 Osmera et al. ..... 400/139
4,712,473 * 12/1987 Amos ..... 101/29
5,024,153 * 6/1991 Bannister et al. ..... 101/91
5,103,722 * 4/1992 Brengman et al. ..... 101/4
5,479,859 * 1/1996 Linder et al. ..... 101/477
5,503,514 * 4/1996 Lamanna et al. ..... 101/23

FOREIGN PATENT DOCUMENTS 398 916 2/1995 (AT) .
27177 11/1964 (DE) .
2 279 283 1/1995 (GB) .

* cited by examiner

*Primary Examiner*—Eugene Eickholt
(74) *Attorney, Agent, or Firm*—Collard & Roe, PC

(57) ABSTRACT

The invention relates to a device for stamping distinguishing marks on the parts moving in the feed direction of a transport device, e.g. a roll line, comprising at least one mark-holder for holding a mark, the mark-holder being removably placed on the circumference of a stamping wheel. The inventive device comprises at least one hopper for the mark-holders. The hopper for the mark-holders and the stamping wheel can be placed relatively to one another, in a position where the mark-holders of the stamping wheel can pass through cavities of the mark-holder hopper, and the mark-holders of the mark-holder hopper can pass directly through cavities of the stamping wheel. A revolver hopper comprising mark-holder pins which can move axially with it is rotatably mounted and has the same axis as the stamping wheel. The stamping wheel is provided with at least one outward push channel which extends radially towards the circumference of the stamping wheel, as well as with a linear driving mechanism which is rotationally fixed on the stamping wheel, to allow radial displacement of a mark-holder pin located in an angular position of the outward push channel, between an inner rest position and an outer stamping position.

12 Claims, 3 Drawing Sheets

DEVICE WITH A MARK-HOLDER HOPPER AND A REVOLVER HOPPER FOR STAMPING DISTINGUISHING MARKS ON MOVING PARTS

The present invention relates to a device for the marking of parts moving in the direction of motion of a conveying device such as a roller table having at least one character carrier carrying one character, said character carrier being exchangeably inserted at the circumference of a stamping wheel.

Devices for the marking of parts (DD-PS 27177) are known where the stamping characters of a stamping character set are arranged in an exchangeable cartridge, said exchangeable cartridge being removably inserted into the stamping wheel so that exchanging of the stamping character set only requires insertion of a new cartridge containing the prepared stamping character set. Exchanging of individual stamping characters within one character set, however, is not possible in this case. Additionally, such devices are not able to meet the ever greater requirements in terms of production speed and automation.

Devices for the exchanging of individual character carriers are also known (AT 398 916). In this type of device, the stamping wheel forms a ring-shaped guide, coaxial with the rotational axis, for the character carriers. The stamping character storage can be rotated stepwise, in relation to the stamping wheel, around the rotational axis of said stamping wheel, and a selected character carrier can be pushed radially outward through a radial outlet opening in the stamping wheel. The disadvantage of this type of device, however, consists in the fact that the character carriers can only be transported to the outlet opening in the order in which they are arranged in the stamping character storage. Additionally, devices of this type suffer from the disadvantage that exchanging of a larger number of character carriers of a character carrier set also requires exchanging of the entire exchangeable cartridge containing the character set.

Therefore, the object of the present invention consists in providing a device for the marking of parts moving in the direction of motion of a conveying device that allows, on the one hand, fast automatic exchanging of substantially entire sets of character carriers where each of the character carriers, however, is exchanged separately and this exchange operation takes place quickly and substantially automatically with a view to production speed and, on the other hand, particularly fast marking of parts in cases where the difference between two consecutive stamping operations is limited to one different character in the character set used, this one character to be exchanged substantially being freely selectable.

This object is attained by a device of the type indicated above by providing at least one character carrier magazine for character carriers, ensuring that the character carrier magazine and the stamping wheel can be moved into positions relative to each other where character carriers of the stamping wheel can be directly transferred into receptacles of the character carrier magazine and character carriers of the character carrier magazine can be directly transferred into receptacles of the stamping wheel, and by providing a pivotally mounted magazine revolver being coaxial with the stamping wheel and containing character carrier pins radially movable therein, at least one outlet channel in the stamping wheel radially extending to the circumference of said stamping wheel and a linear drive non-pivotally mounted on the stamping wheel enabling radial shifting of a character carrier pin located in the angular position of the outlet channel from an internal inoperative position to an external impacting position.

The invention disclosed hereunder allows fast marking of parts, especially sections, with different characters, the invention standing out for particularly great flexibility as far as the type of marking is concerned.

In this respect, it is advantageous to connect with the linear drive a thrust piece that can, with a nose, engage in a groove of the character carrier pin. With the help of this thrust piece, the character carrier pin can be moved into its impacting position or drawn from its impacting position back into its internal inoperative position, respectively.

Additionally, it is advantageous to provide springs keeping the character carrier pins in their respective inoperative positions in the magazine revolver. Thus, radial dislocation of the character carrier pins during rotation of the magazine revolver caused by the centrifugal force and/or gravity occurring during rotation is prevented so that unhindered engaging of the thrust piece with its nose in a groove of the respective character carrier pin being transported into the outlet channel is ensured.

In a practically tested and reliable embodiment, the linear drive is a hydraulic drive.

It is also recommendable to position the outlet channel within the area of the character carriers inserted at the circumference of the stamping wheel in order to allow modification of the character set by exchanging a character carrier pin located in its impacting position in the outlet channel.

It is, furthermore, of advantage to provide clamping pieces to clamp the character carriers into the receptacles of the stamping wheel and to provide springs to clamp the clamping pieces into the recesses of the character carriers. Thus the character carriers in the receptacles of the stamping wheel are protected against dislocation during the stamping operation and positioning of the stamping wheel in the exchange position.

It is recommendable to provide releasing pins acting on the clamping pieces located in bores substantially parallel to the axis at the circumference of the stamping wheel to release the clamped character carriers, thus creating the preconditions for moving the character carriers into the character carrier magazine.

If is, furthermore, of advantage to provide drivable pins to push character carriers out of the stamping wheel into a receptacle of the character carrier magazine as well as drivable pins to move character carriers out of the character carrier magazine into the stamping wheel. Said pins allow substitution of character carriers from the character carrier magazine for character carriers from the stamping wheel and vice versa.

Additionally, it is recommendable to design the character carrier magazine, one character carrier magazine representing the absolutely required minimum, in such a way that it is wheel-shaped and can be rotated around its own axis and to position character carriers that can be radially shifted at the circumference of said character carrier magazine. Thus it is possible to position the character carrier to be exchanged of the character carrier magazine, by rotating the character carrier magazine, in the immediate vicinity of the receiving position for the character carrier in the stamping wheel in such a way that the character carrier can then be transferred into the receptacle of the stamping wheel.

Another advantageous feature, finally, consists in a distance measuring device for the moving parts being provided to ensure that the position of the stamping unit carrying the stamping wheel is adequately adjusted as said parts move along. With the help of said distance measuring device, the horizontal deviation from a theoretical position of the parts to be marked moving on a conveying device is determined, and the stamping wheel can be permanently kept above the parts to be marked with the help of a position adjusting mechanism.

In the following, the invention is described, in the form of one possible embodiment, on the basis of the drawings.

Figure 1:
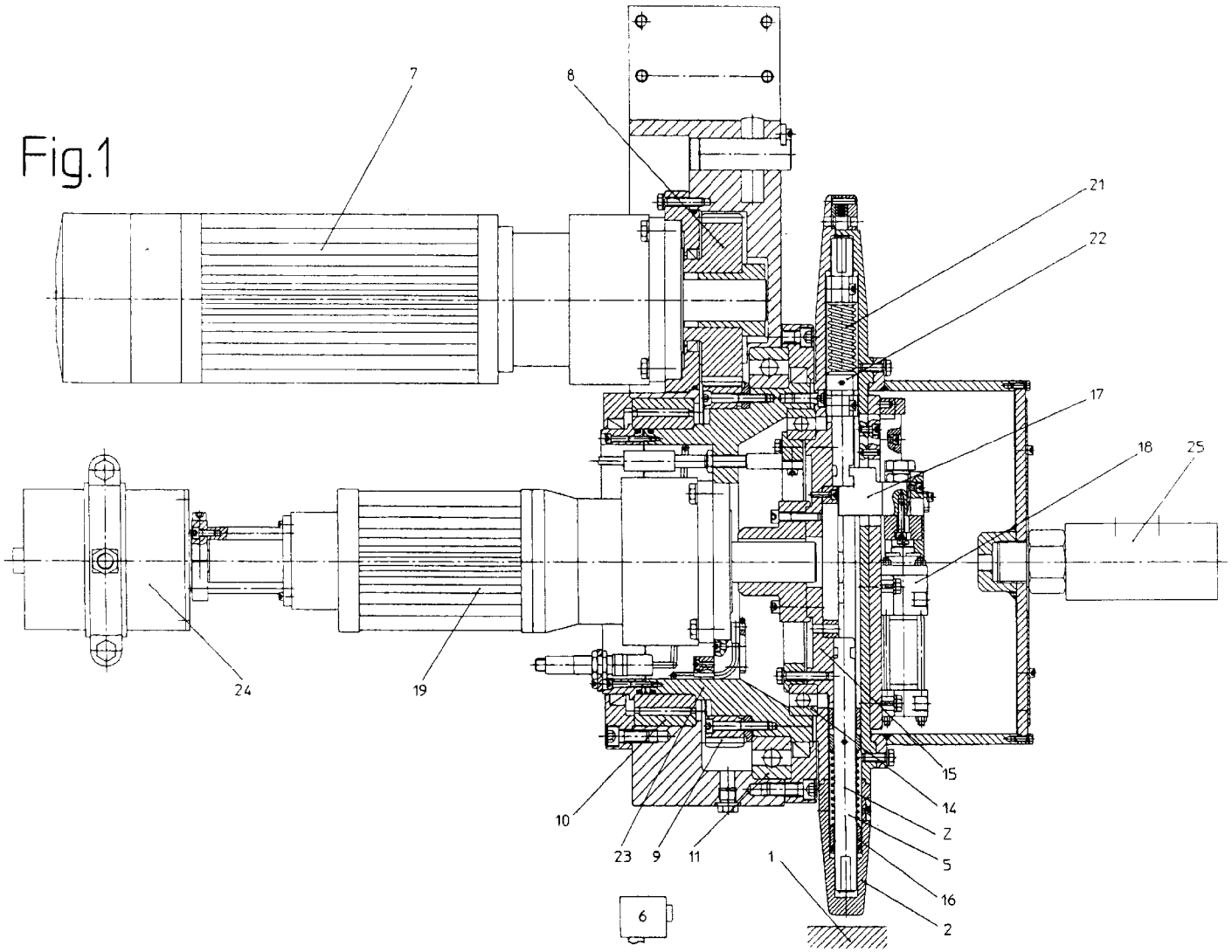
FIG. 1 shows a section through part of a device according to the present invention with a revolving magazine connected to the stamping wheel.
Figure 2:
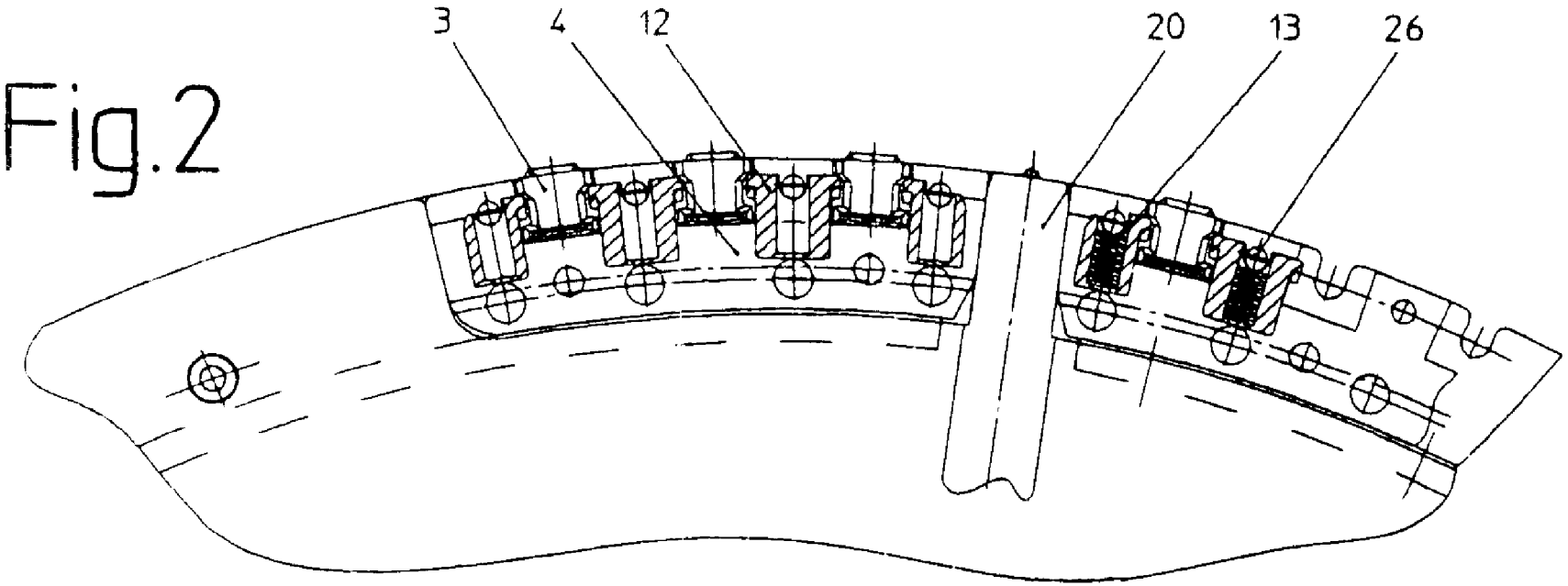
FIG. 2 shows a section through a character carrier holder with character carriers inserted therein and an outlet channel.

FIG. 1 shows a stamping wheel 2, in this embodiment eccentrically designed, with character carriers 3 for the marking of parts 1, especially sections such as rails, moving on a conveying device, inserted at the circumference of a partial segment. These character carriers 3 are, as illustrated in FIG. 2, inserted in a character carrier holder 4. The stamping wheel 2 can be accelerated with the help of a drive 7, and its circumferential speed can be synchronized taking the speed of the moving parts 1 into account. For this purpose, the stamping wheel 2 is driven via a spur gear 8 and 9 and the rolling bearings 10 and 11 together with the pertaining additional elements known to the expert. Additionally, a distance measuring device 6 is shown that allows continuous horizontal adjustment, with the help of a drive provided for this purpose, of the position of the stamping wheel 2 above the parts 1 to be marked.

Figure 3:
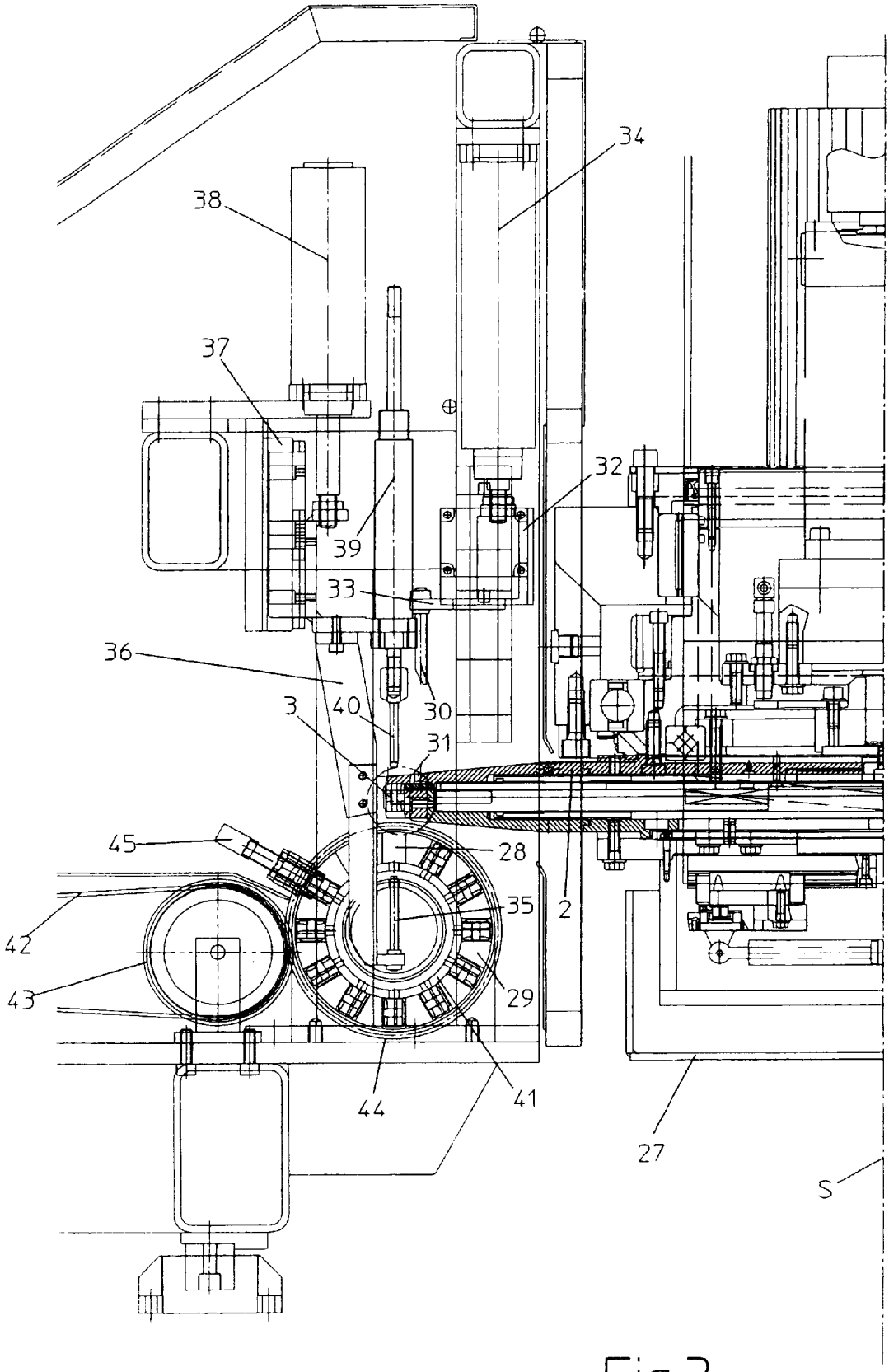
FIG. 3 shows a section trough part of a device according to the present invention with a stamping wheel mounted in a stamping unit and a wheel-shaped character carrier magazine connected thereto.

The character carrier holder 4, illustrated in detail in FIG. 2, contains several character carriers 3 arranged in a row one behind the other at identical or different intervals, thus yielding a curved arrangement of character carriers 3. These character carriers 3, which can be different or partly or entirely identical character carriers, are clamped with the help of clamping pieces 12 that are located in rectangular slip-in guides in the character carrier holder 4 and engage in recesses in the character carriers 1, thus protecting them against radial dislocation in relation to the stamping wheel 2. Springs 13 and thrust pins 26 are used to press the clamping pieces 12 radially in the direction of the axis of symmetry S of the stamping unit 2 in order to clamp the character carriers 3. This axis of symmetry S as well as the stamping unit 27 are shown in FIG. 3.

Due to the eccentricity of the stamping wheel 2, contact occurs—after partial rotation of the stamping wheel 2 by the drive 7 arranged parallel to the center line of the stamping wheel 2 and with synchronization duly taking the speed of the parts 1 passing under the stamping wheel as well as speed changes, if any, into account—between the stamping roller 2 and the part passing below the stamping wheel immediately before the partial segment at the circumference of the stamping roller 2 where the character carriers 3 are inserted in the character carrier holder 4.

The force thereby exerted by the part 1 to be marked against the stamping wheel 2 and, thus, against the entire stamping unit 27 in which the stamping wheel 2 is pivotally mounted, which causes lifting of the stamping unit 27 above its suspension and guiding system, is counteracted by an automatically pre-adjusted force required for the respective parts to be marked, thus ensuring that stamping is performed with constant and adequate pressure. The stamping unit 27 is shown in FIG. 3.

After this marking operation, the stamping roller 2, on grounds of its eccentricity, moves away from the part to be marked as it continues to rotate. The marking operation can now be terminated, repeated with the same character set or the character set can, in whole or in part, be exchanged for a subsequent stamping operation. Additionally, it is possible to imprint, for example, a series of consecutive markings where only one sign of the character set used changes from one marking operation to the next.

As also shown by FIG. 1, a revolving magazine 15 containing one or several character carrier pins 5 movably arranged in radial slip-in guides 16 along its circumference is, via a rolling bearing 14, mounted in such a way that it is coaxial with the stamping wheel 2. In order to exchange a single character carrier of a character carrier set between two consecutive marking operations directly and quickly following each other, one character carrier pin 5, located in its impacting position in an outlet channel 20 of the stamping wheel 2 in the area of the character carrier holder 4 and being flush with the other character carriers 3, as shown in FIG. 2, is, with the help of a thrust piece 17 controlled by a hydraulic linear drive 18 working parallel to the stamping axis Z, moved into its radial internal inoperative position. The character carrier 5 is thus located outside the outlet channel 20 in the character carrier holder 4 and can thus be freely rotated with the revolving magazine 15 within the eccentric stamping wheel 2.

With the help of the drive 19, the coaxially arranged revolving magazine 15 can then, within the stamping wheel 2 and irrespective of the position of the stamping wheel 2, be rotated in any desirable direction around its bearing axis until another character carrier pin 5 inserted in the revolving magazine 15 enters the area of the outlet channel 20.

With the help of the linear drive 18 and via the thrust piece 17, another pre-selected character carrier pin 5 is pushed through the outlet opening 20 into the external impacting position at the circumference of the stamping wheel 2 until it is flush with the other character carriers 3. In this position, the character carrier pin 5 is, with a constant force exceeding the force exerted by the parts to be marked during the marking operation, held by the thrust piece, the thus required force being produced by the linear drive 18.

The further character carrier pins 5 arranged in the revolving magazine 15 that are not located in the area of the outlet channel, are, via pressure springs 21 counteracting radial dislocation as a consequence of centrifugal force and/or gravity, kept in their internal inoperative positions. Thus unhindered engaging of the thrust piece 17, with its nose, in a groove of the character carrier pin 5 moving into the outlet channel is enabled. The character carrier pins 5 can thus, in their slip-in guides, only be moved in combination with the thrust piece 17, inverted positioning of noses and grooves, of course, also being possible, i.e. the noses can be formed to the character carrier pins 5 and the grooves to the thrust piece 17. The clamping pieces 22 mounted on the character carrier pins 5 permanently secure these against axial rotation in relation to the stamping axis Z This exchange operation takes less than one second and takes place between two stamping operations, can be repeated several times and ensures that several consecutive stamping operations printing a different or identical stamp image can be performed within a very short time.

The drive 19, fixed on the housing 23 that is pivotally mounted via the rolling bearings 10 and 11 and connected with the stamping roller, is supplied with energy via the slip ring 24, while a rotatable fluid connection 25 is used to supply energy to the drive 18 that is non-pivotally mounted on the stamping roller 2.

Closer inspection of FIG. 3 reveals another possibility of exchanging character carriers that consists in moving the stamping wheel 2, pivotally mounted within the stamping unit 27, into a radial angular position pre-determined for a character carrier exchange operation, so that a character carrier 3 can be transferred from the stamping wheel 2 into an empty receptacle 28 of a—in the case of the present embodiment wheel-shaped—character carrier magazine 29 and a character carrier from said character carrier magazine 29 can be transferred into an empty receptacle of the stamping wheel 2.

In this precisely defined position, several character carriers 3 radially arranged at the circumference of the stamping wheel 2 are simultaneously and automatically exchanged as described below. The receptacles for the character carriers 3 are, in the present embodiment, located in the character carrier holder 4 that is radially arranged in a partial segment at the circumference of the stamping wheel. This character carrier holder 4, shown in detail in FIG. 2, contains several character carriers 3 arranged in a row one behind the other at identical or different intervals, thus resulting in a curved arrangement of the character carriers 3. These character carriers 3, which can be different or partly or entirely identical character carriers, are, during the stamping operation and during positioning of the stamping wheel 2 in the exchange position, clamped radially to the axis of symmetry S of the stamping unit 27 in which the stamping wheel 2 is pivotally mounted, by clamping pieces 12 that are located in rectangular slip-in guides in the character carrier holder 4 and engage in recesses of the character carriers 3. Springs 13 and thrust pins 26 are used to push the clamping pieces 12 radially in the direction of the axis of symmetry S of the stamping unit 27 in order to clamp the character carriers 3.

After positioning the stamping wheel 2 in the character exchange position, the clamping pieces 12 must, at the beginning of the exchange operation, be lifted, within the prismatic slip-in guides of the character carrier holder 4 and radially to the axis of symmetry S of the stamping unit 27, in the direction of the circumferential edge of the stamping wheel 2 until the character carriers 3 to be exchanged are no longer clamped in place and unhindered moving of the character carriers 3 parallel to the axis of symmetry S of the stamping unit 27 in the recesses provided for this purpose in the character carrier holder 4 is enabled.

For this purpose, releasing pins 30 with chamfered ends are inserted into the character carrier holder 4 through bores 31 located at the circumference of the stamping wheel 2 and extending in a direction parallel to the axis of symmetry S of the stamping unit 27, thus causing the clamping pieces 12 to be lifted by the releasing pins 30 in the direction of the circumferential edge of the stamping wheel 2 and enabling moving of the character carriers 3 within the character carrier holder 4 in a direction parallel to the axis of symmetry S of the stamping unit 27. The releasing pins 30 are arranged on a slide 33 mounted on linear guides 32 in a curve corresponding to the curved arrangement of the clamping pieces 12 in the character carrier holder 4. The insertion of the releasing pins 30 mounted on the slide 33 is controlled by pneumatic cylinders 34, the number of cylinders 34 used depending on the number of character carriers 3 to be exchanged. The pneumatic cylinders 34 stay in their most recent position until the character carriers 3 have been exchanged.

The character carriers 3, being unsecured after lifting of the clamping pieces 12, are secured against dropping out of the character carrier holder 4 by means of pins 35 with chamfered ends. For this purpose, pins 35, arranged on a slide 36 in a curve corresponding to the arrangement of the character carriers 3 in the character carrier holder 4 that are, parallel to the linear guide 37 holding the slide 36, offset in such a way that insertion of the pins 35 into the interior of the character carrier magazines 29 is enabled, are pressed against the character carriers 3 in a direction parallel to the axis of symmetry S of the stamping unit 27 by means of the pneumatic cylinders 38.

Pneumatic cylinders 39, the number of which also depends on the number of character carriers to be exchanged, are used to insert pins 40 with chamfered tips into further bores arranged in a curve at the circumference of the stamping wheel 2 and extending parallel to the axis of symmetry S until they thrust against the pins 35 securing the character carriers 3 against dropping out of the character carrier holder 4. Further insertion of the pins 40 causes the character carriers 3, now protected against rotation as a consequence of being clamped by the pins 35 and 40, to be moved in the direction of the character carrier magazines 29 along a path parallel to the axis of symmetry S of the stamping unit 27.

Said wheel-shaped character carrier magazines 29 are provided, at their circumference, with several rectangular receptacles 41 extending radially to their central points and containing different character carriers. The character carrier magazines 29 are located in positions where one empty receptacle is located directly opposite one character carrier 3 to be exchanged located in the stamping wheel 2. Generally, these positions of the character carrier magazines 29 are those where the magazines 29 remained after the most recent exchange operation. The character carriers 3 are now, as described above, moved until they rest against a radial ring-shaped stop 41 in the respective character carrier magazine 29, thus preventing further inward movement of the character carriers. The pneumatic cylinders 39 are then moved back into their initial positions corresponding to their top end positions, thus enabling rotary movement of the wheel-shaped character carrier magazines 29.

Gear wheels 43 driven via toothed belts 42 are used to rotate and position each character carrier magazine 29 in such a way that a pre-selected character carrier required for the respective next marking operation is facing in the direction of the outlet position, i.e. is positioned parallel to the axis of symmetry S of the stamping unit 27 in the direction of the character carrier holder 4. During the rotational movement performed by the character carrier magazines 29, the character carriers 3 are by means of external ring-shaped guides 44 prevented from dropping out. Exact positioning of the character carriers through rotational movement of the character carrier magazine 29 is additionally monitored by means of the monitoring switch 45.

After moving of the character carrier magazine 29 into the position required for the exchange operation, the pins 40, controlled by the pneumatic cylinder, are moved until they press the character carrier to be moved out of the magazine 29 into a receptacle of the stamping wheel 2 against the ring-shaped stop 41. Then the character carriers are, by the pins 35 moving into the receptacles 41 and the pins 40, clamped in place, thus protecting them against rotation. Further insertion finally causes the character carriers to be inserted into the receptacles provided for this purpose in the character carrier holder 4 of the stamping wheel 2. The pneumatic cylinder 34 is moved back into its initial position, which at the same time causes the releasing pins 30 to be moved out of the character carrier holder 4 along a path parallel to the axis of symmetry S. This causes the clamping pieces 12, initially pushed radially upward in the direction of the circumferential edge of the stamping wheel 2 by the releasing pins 30, to be pushed in the direction of the axis of symmetry S by the springs 13, thus locking the newly inserted character carrier in place.

The character carrier exchange mechanism described immediately above is particularly suitable for the exchanging of parts of a character set or entire character sets, respectively. This mechanism can, of course, also be used to exchange only individual character carriers of a set. In the case of said exchange operation to be performed during two consecutive stamping operations following each other at a short interval, it is more preferable to use the individual character carrier exchange mechanism described further above.

The particular advantage offered by the device described herein consists mainly in its flexibility as far as the marking of parts moving on a conveying device, e.g. the marking of sections with different character sets, is concerned as the device can be operated without an exchange mechanism or, optionally, with one or both of the two mechanisms described herein.

A further advantage offered by the device described herein consists in the fact that the eccentric stamping wheel pivotally mounted in the stamping unit can, by means of the distance measuring device for the parts to be marked, permanently be kept above the parts to be marked by a suitable type of drive, even in cases where said parts deviate from their theoretical marking position. A detailed description hereof is contained in a parallel application under the Hungarian application number P 97 02 363.

What is claimed is:

1. Device for the marking of parts (1) moving in the direction of motion of a conveying device such as a roller table, having at least one character carrier (3) carrying one character, said character carrier being exchangeably inserted at the circumference of a stamping wheel (2), wherein at least one character carrier magazine (29) for character carriers (3) is provided and the character carrier magazine (29) and the stamping wheel (2) can be moved into positions relative to each other where character carriers of the stamping wheel (2) can be directly transferred into receptacles (28) of the character carrier magazine-(29) and character carriers of the character carrier magazine (29) can be directly transferred into receptacles of the stamping wheel (2), and wherein a magazine revolver (15) containing character carrier pins (5) radially movable therein is pivotally mounted in such a way that it is coaxial with the stamping wheel (2), at least one outlet channel (20) radially extending to the circumference of the stamping wheel is provided in the stamping wheel and a linear drive (18) non-pivotally mounted on the stamping wheel (2) is provided for radial shifting of a character carrier pin (5) located in the angular position of the outlet channel from an internal inoperative position to an external impacting position.

2. Device according to claim 1, wherein a thrust piece (17) that can engage with a nose in a groove of the character carrier pin (5) is connected with the linear drive (18).

3. Device according to claim 1, wherein the character carrier pins (5) are held in their inoperative positions in the magazine revolver (15) by springs (21).

4. Device according to claim 2, wherein the linear drive (18) is a hydraulic drive.

5. Device according to claim 1, wherein the outlet channel (20) is located in the area of the character carriers (3) inserted at the circumference of the stamping wheel (2).

6. Device according to claim 1, wherein the character carriers (3) can be clamped in the receptacles of the stamping wheel (2) by clamping pieces (12).

7. Device according to claim 6, wherein the clamping pieces (12) can be clamped in a recess of the character carrier (3) by means of springs (13).

8. Device according to claim 1, wherein the clamped character carriers (3) can be released by means of releasing pins (30) acting on the clamping pieces (12) and located in bores (31) essentially arranged parallel to the axis at the circumference of the stamping wheel (2).

9. Device according to claim 1, wherein drivable pins (40) for moving character carriers (3) out of the stamping wheel (2) into a receptacle (28) of the character carrier magazine (29) as well as drivable pins (35) for moving character carriers out of the character carrier magazine (29) into the stamping wheel (2) are provided.

10. Device according to claim 1, wherein the character carrier magazine (29), one character carrier magazine representing the absolute minimum required, is wheel-shaped and can be rotated around its own axis.

11. Device according to claim 10, wherein character carriers that can be moved in a radial direction are arranged at the circumference of the wheel-shaped character carrier magazine (29), one character carrier magazine representing the absolute minimum required.

12. Device according to claim 1, wherein a distance measuring device (6) for the moving parts is provided in order to allow adjustment of the position of the stamping unit (27) carrying the stamping wheel (2).

* * * * *